US006974394B1

(12) United States Patent
Tang et al.

(10) Patent No.: US 6,974,394 B1
(45) Date of Patent: Dec. 13, 2005

(54) PUTTER HEAD

(75) Inventors: Larry G. Tang, Carlsbad, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/710,557

(22) Filed: Jul. 20, 2004

(51) Int. Cl.[7] ..... A63B 53/04; A63B 53/06
(52) U.S. Cl. ..... 473/335; 473/341; 473/350
(58) Field of Search ..... 473/324–350

(56) References Cited

U.S. PATENT DOCUMENTS

| | | | | |
|---|---|---|---|---|
| 4,688,798 | A | 8/1987 | Pelz | |
| 4,793,616 | A | 12/1988 | Fernandez | |
| 5,470,068 | A | 11/1995 | Schmidt et al. | |
| 5,951,412 | A | 9/1999 | Rose et al. | |
| 6,086,484 | A | 7/2000 | Uebelhor | |
| 6,375,583 | B1 * | 4/2002 | Solheim | 473/329 |
| 6,796,911 | B2 * | 9/2004 | Grace | 473/251 |
| 6,896,625 | B2 * | 5/2005 | Grace | 473/251 |
| 6,929,559 | B1 * | 8/2005 | Grace | 473/251 |
| 6,929,564 | B2 * | 8/2005 | Olsavsky et al. | 473/340 |
| 2005/0192114 | A1 | 9/2005 | Zider et al. | |

* cited by examiner

*Primary Examiner*—Gregory Vidovich
*Assistant Examiner*—Alvin A. Hunter, Jr.
(74) *Attorney, Agent, or Firm*—Michael A. Catania; Elaine H. Lo

(57) ABSTRACT

A putter-type club head (20) has a body (22) that is preferably composed of a material having a density ranging from ranging from 2.0 g/cm$^3$ to 3.0 g/cm$^3$. The body (22) has a plurality of mass ports (50, 52 and 54) and a plurality of mass members (56, 58, and 60), each of which is located in a respective mass port. The body (22) further includes a heel aperture (34) and a toe aperture (36).

9 Claims, 4 Drawing Sheets

PUTTER HEAD

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to a putter-type club head. More specifically, the present invention relates to a putter-type club head having a multiple weighting system.

2. Description of the Related Art

One example of a putter is described in Schmidt et al., U.S. Pat. No. 5,470,068, for a Golf Putter With Dished Bottom Surfaces. Schmidt discloses a putter composed of a single cast material and having a hollow interior.

Another example is Uebelhor, U.S. Pat. No. 6,086,484, for a Golf Putter Head. Uebelhor discloses a putter head with a U-shaped body and a block within the middle. The block has a lower specific gravity than the U-shaped body.

Yet another example is Rose et al., U.S. Pat. No. 5,951,412 for a Golf Club, Particularly A Putter. The Rose patent discloses a center portion composed of a light metal material and the heel and toe portions composed of heavier metals. The metals are forged or cast to create the putter head.

Another example is Fernandez, U.S. Pat. No. 4,793,616 for a Golf Club. Fernandez discloses a lightweight composite material molded to a hard, high density material for distribution of mass. Fernandez discloses a composite shell with a high density insert composed of tungsten or some other high density material.

Alternative alignment means are disclosed in U.S. Pat. No. 4,688,798, entitled Golf Club And Head Including Alignment Indicators, assigned to the Callaway Golf (the assignee of the Present Application), which pertinent parts are hereby incorporated by reference. The alignment means assists a golfer in properly aiming a golf ball toward a hole when putting. Alternative alignment means, including a large white strip may be utilized in the present invention.

SUMMARY OF INVENTION

One aspect of the present invention is a putter-type club head including a body and a plurality of mass members. The body preferably includes a front section, an aft section, a heel section, a toe section and a central section. The body preferably has a heel aperture defined by the heel section, central section, front section and aft section, and a toe aperture defined by the toe section, central section, front section and aft section. A face wall of the front section preferably has a first mass port and a second mass port, and a sole wall of the central section preferably has a third mass port. A first mass member is preferably disposed in the first mass port. A second mass member is preferably disposed in the second mass port. A third mass member is preferably disposed in the third mass port. The putter-type club head preferably has a moment of inertia about the Iyy axis through the center of gravity of the club head of at least 500 g-cm$^2$.

Another aspect of the present invention is a putter-type club head including a body and at least three mass members.

The body is preferably composed of an aluminum material having a density ranging from 2.0 g/cm$^3$ to 3.0 g/cm$^3$. The body preferably has a heel aperture and a toe aperture. The body preferably has a length from front to rear within 1.5 centimeters of the width of the body from heel to toe. The at least three mass members are preferably positioned within the body. Each of the at least three mass members is preferably composed of a material having a density ranging from 6.0 g/cm$^3$ to 20.0 g/cm$^3$.

Yet another aspect of the present invention is a putter-type club head including a body composed of a material having a density ranging from 0.90 g/cm$^3$ to 6.0 g/cm$^3$ and three mass members threadingly engaged within three mass ports of the body. The body includes a front section, an aft section, a heel section, a toe section and a central section. The body has a heel aperture defined by the heel section, central section, front section and aft section, and a toe aperture defined by the toe section, central section, front section and aft section. The face wall of the front section has a first mass port and a second mass port, and a sole wall of the central section has a third mass port. Each of the mass members is composed of a material having a density ranging from 6.0 g/cm$^3$ to 20.0 g/cm$^3$.

Yet another aspect of the present invention is a putter-type club head including a body having a mass ranging from 100 grams to 400 grams, and three mass members threadingly engaged within three mass ports of the body. Each of the mass members preferably has a mass of at least 10 grams.

Yet another aspect of the present invention is a putter-type club head including a body, four mass members threadingly engaged within mass ports in the body, and a crown plate.

Yet another aspect of the present invention is a putter-type club head including a body composed of an aluminum material having a density ranging from 2.0 g/cm$^3$ to 3.0 g/cm$^3$, and at least three mass members positioned within the body. The body preferably has a heel aperture and a toe aperture. The body preferably has a length from front to rear within 1.5 centimeters of the width of the body from heel to toe, and a height of from 1.0 centimeters to 2.5 centimeters. Each of the at least three mass members is composed of a material having a density ranging from 6.0 g/cm$^3$ to 20.0 g/cm$^3$.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
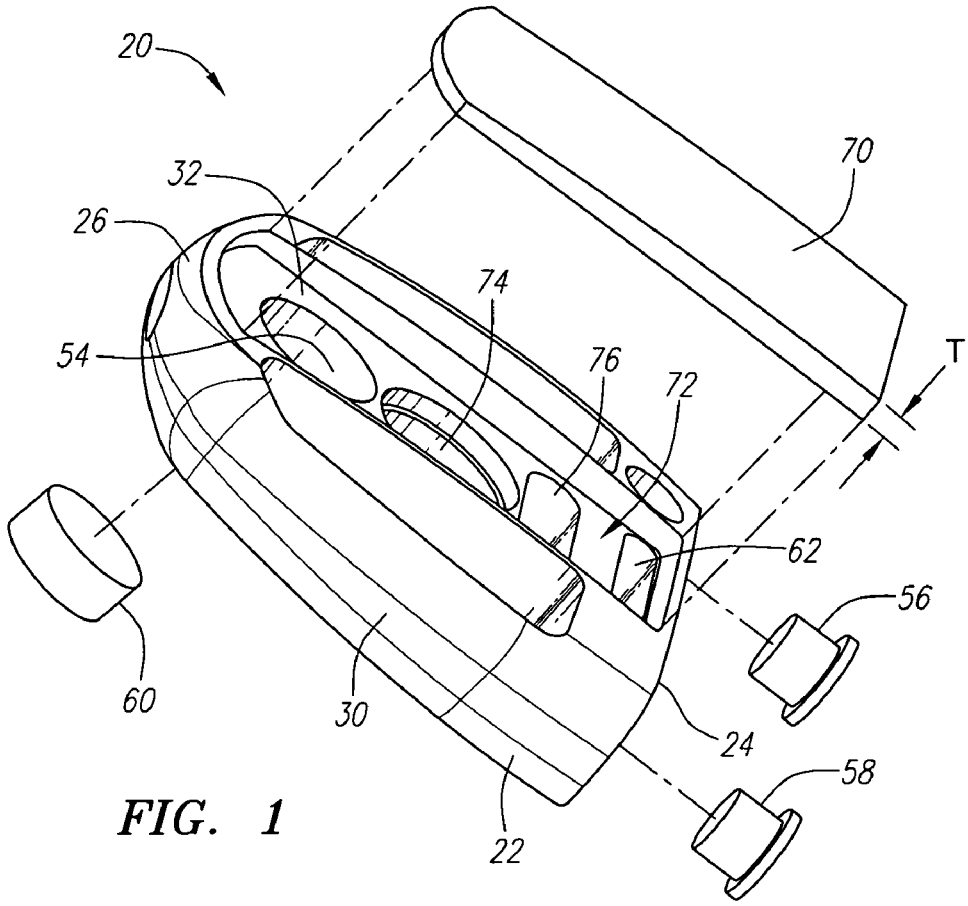
FIG. 1 is an exploded view of a putter-type club head.
Figure 2:
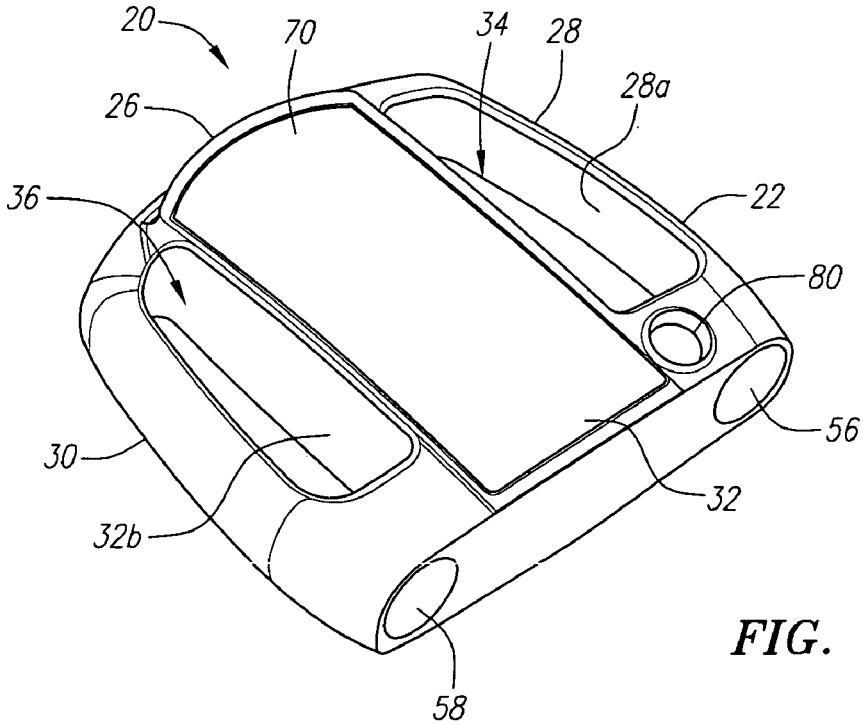
FIG. 2 is a top perspective view of a putter-type club head.

As shown in FIGS. 1–8, a putter-type club head of the present invention is generally designated 20. The club head 20 has a body 22 that is preferably composed of a cast metal. In a preferred embodiment, the body 22 is composed of a material having a density ranging from 0.90 g/cm$^3$ to 6.0 g/cm$^3$. A preferred metal for the body 22 is an aluminum alloy. Alternative materials for the body 22 include aluminum, titanium, titanium alloys, magnesium, magnesium alloys, and the like. The body 22 is preferably formed as a single cast structure using known investment casting techniques. However, those skilled in the pertinent art will recognize that alternative forming techniques such as milling, welding forged or formed pieces, and the like may be utilized without departing from the scope and spirit of the present invention.

The body 22 preferably has a front section 24, an aft or rear section 26, a heel section 28, a toe section 30 and a central section 32. The central section 32, the heel section 28, the rear section 26 and the front section 24 preferably define a heel aperture 34. The central section 32, the toe section 30, the rear section 26 and the front section 24 preferably define a toe aperture 36. The front section 24 includes a face 38 that is preferably milled. The upper surface of the body 22 defines a crown 40 and the lower surface of the body 22 defines a sole 42. A central slot 62 is preferably located in the sole 42 of the front section 24. A hosel 80 is preferably located in the crown 40 of the front section 24 for receiving a shaft, not shown.

The body 22 preferably has a plurality of ports for placement of mass. In a preferred embodiment, the body 22 has a first mass port 50, a second mass port 52 and a third mass port 54. The first mass port 50 is located in the heel side of the front section 24 and accessible through an opening in the face 38. The second mass port 52 is located in the toe side of the front section 24 and accessible through an opening in the face 38. The third mass port 54 is located in the central section 32 and accessible through an opening in the sole 42. Each of the first mass port 50 and the second mass port 52 preferably has a depth of approximately 1.5 centimeters ("cm") and a diameter of approximately 1 cm. The third mass port 54 preferably extends through the body 22 and preferably has a diameter of approximately 2 cm.

In a preferred embodiment, the putter-type club head 20 has a plurality of mass members for weighting the putter-type club head 20. In a preferred embodiment, the putter-type club head 20 has a first mass member 56, a second mass member 58 and a third mass member 60. Preferably, the first mass member 56 is positioned within the first mass port 50, the second mass member 58 is positioned within the second mass port 52, and the third mass member 60 is positioned within the third mass port 54.

In a preferred embodiment, each of the first mass member 56, second mass member 58 and third mass member 60 is composed of a material having a density greater than the density of the material of the body 22. In a preferred embodiment, each of the first mass member 56, second mass member 58 and third mass member 60 is composed of a material having a density ranging from 6.0 g/cm$^3$ to 20.0 g/cm$^3$. In a preferred embodiment, each of the first mass member 56, second mass member 58 and third mass member 60 is composed of a brass material (density of approximately 8.0 g/cm$^3$). Alternatively, each of the first mass member 56, second mass member 58 and third mass member 60 is composed of a material selected from the group consisting of stainless steel, tungsten, silver, gold, nickel, nickel based alloys, iron based alloys, tin, copper and platinum.

In a preferred embodiment, each of the first mass member 56, second mass member 58 and third mass member 60 is threadingly engaged to and removable from a corresponding one of the first mass port 50, the second mass port 52 or the third mass port 54 thereby allowing for adjustments to the mass of the putter type club head 20. Alternatively, each of the first mass member 56, second mass member 58 and third mass member 60 is adhesively bonded or press-fitted to a corresponding one of the first mass port 50, the second mass port 52 or the third mass port 54.

The body 22 preferably weighs from 100 grams to 400 grams, more preferably from 150 grams to 250 grams, even more preferably from 175 grams to 225 grams and most preferably 200 grams. The first mass member 56 and the second mass member 58 are preferably equal in mass and preferably each has a mass ranging from 10 grams to 100 grams, more preferably from 15 grams to 50 grams, and most preferably 25 grams. The third mass member 60 preferably has a mass greater than the mass of the first mass member 56 and the second mass member 58, and preferably has a mass ranging from 10 grams to 200 grams, more preferably from 20 grams to 150 grams, and most preferably 50 grams.

In a preferred embodiment, the first mass member 56, the second mass member 58 and third mass member 60 are all composed of a similar material, most preferably a brass material. In an alternative embodiment, the third mass member 60 is composed of a different material, preferably a denser material such as a tungsten material.

Figure 5:
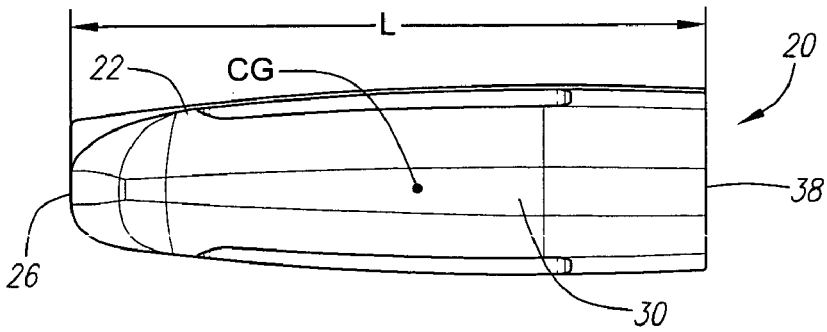
FIG. 5 is a toe side view of the putter-type club head of FIG. 2.
Figure 6:
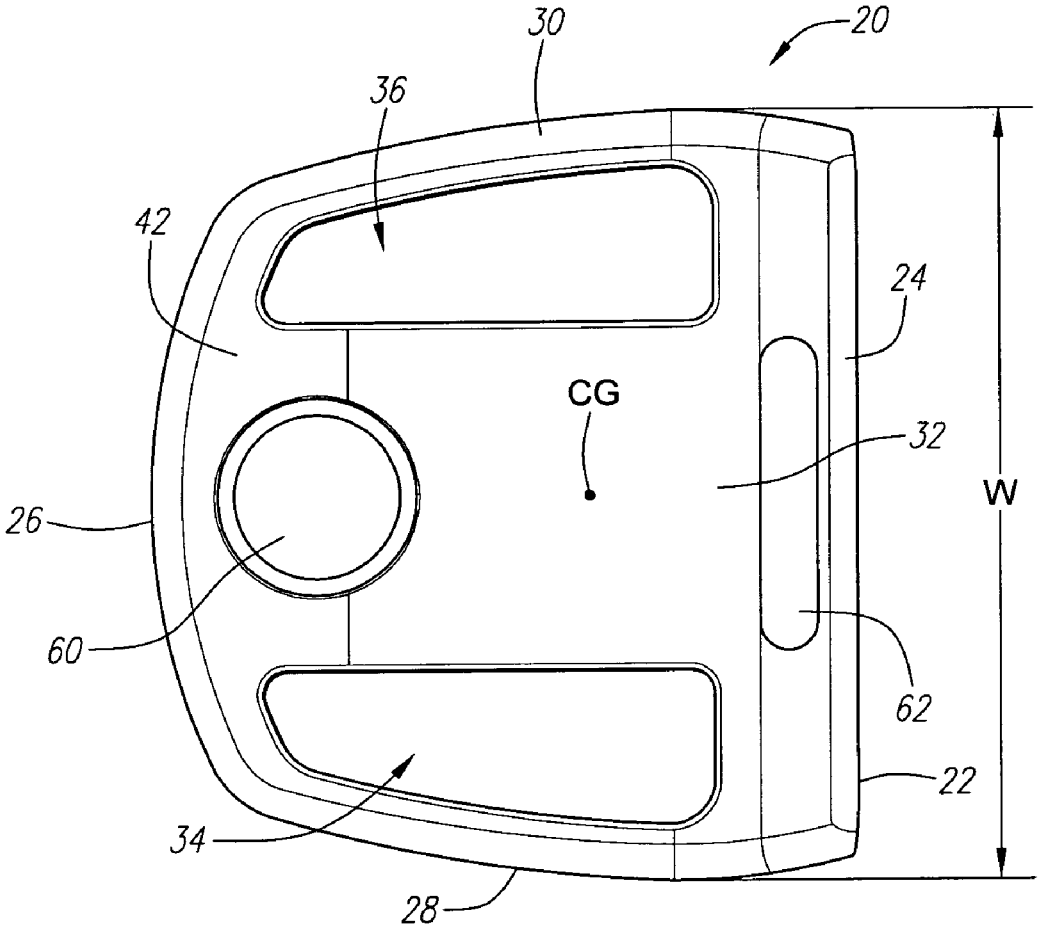
FIG. 6 is a bottom plan view of the putter-type club head of FIG. 2.

As shown in FIG. 5, the body 22 preferably has a length, L, from the face 38 to the rearward most end of the rear section 26 preferably ranging from 6 cm to 14 cm, more preferably from 8 cm to 12 cm, and most preferably 9 cm. As shown in FIG. 6, the body 22 has a width, W, from the farthest edge of the heel section 28 to the farthest edge of the toe section 30 preferably ranging from 6 cm to 14 cm, more preferably from 8 cm to 12 cm, and most preferably 10 cm. In one alternative embodiment, the body 22 has a length, L, that is equal to the width, W.

Figure 7:
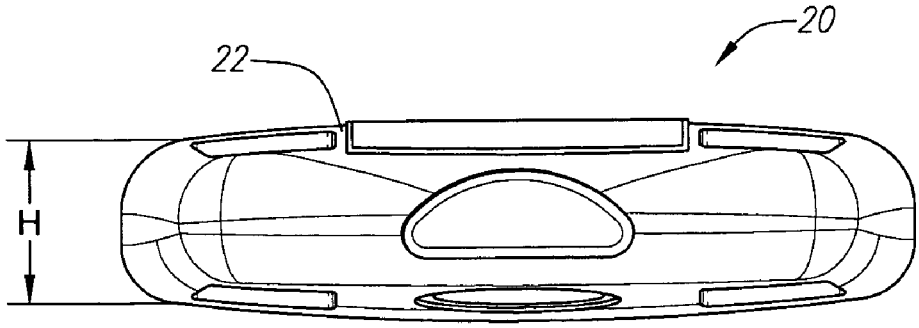
FIG. 7 is a back plan view of the putter-type club head of FIG. 2.

As shown in FIG. 7, the body 22 has a height, H, the farthest edge of the crown 40 to the farthest edge of the sole 42 preferably ranging from 1 cm to 3 cm, more preferably from 2 cm to 2.75 cm, and most preferably 2.5 cm.

The central section 32 preferably has a main recess 72 formed in the crown 40. The main recess 72 provides access to the third mass port 54, an auxiliary mass port 74 and an auxiliary slot 76. A crown plate 70 preferably covers the main recess 72. The crown plate 72 preferably has a length of approximately 8.3 cm, and preferably has a thickness, T, of approximately 0.6 cm. The crown plate 72 is preferably composed of a non-metal material such as a thermoplastic or thermosetting polymer. A preferred material is a thermoplastic polyurethane. In a preferred embodiment, the crown plate 70 preferably has an alignment mechanism for assisting a golfer during a putt. A preferred alignment mechanism is disclosed in U.S. Pat. No. 6,506,125, which pertinent parts are hereby incorporated by reference. The crown plate 70 is preferably removable thereby allowing for various alignment mechanisms to be utilized with the putter-type club head 20.

Figure 3:
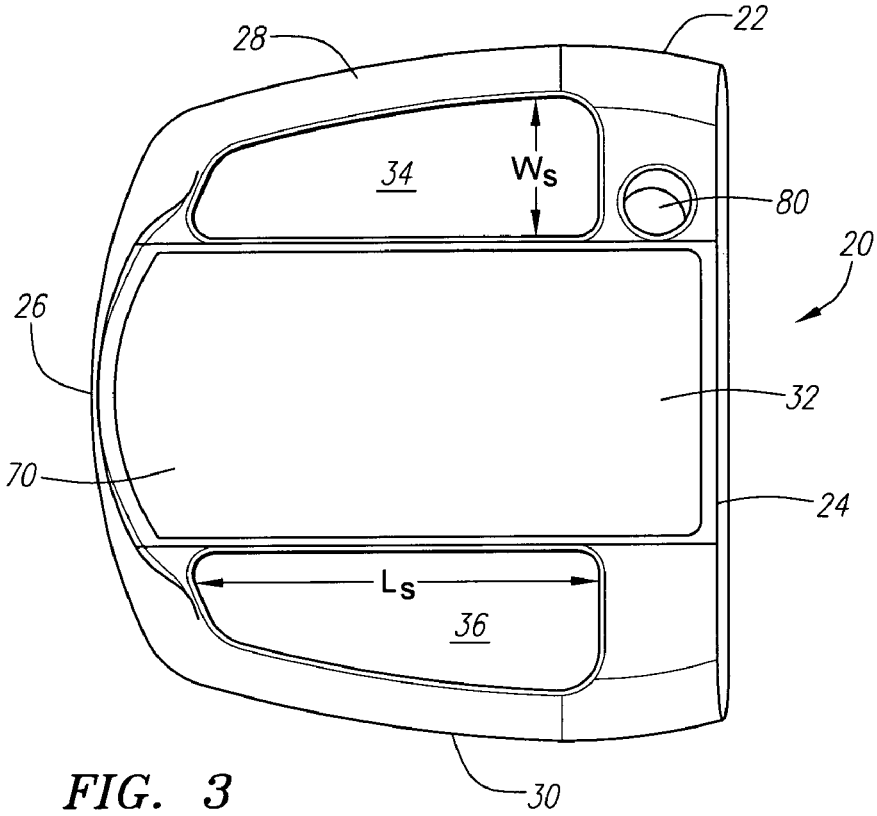
FIG. 3 is a top plan view of the putter-type club head of FIG. 2.
Figure 4:
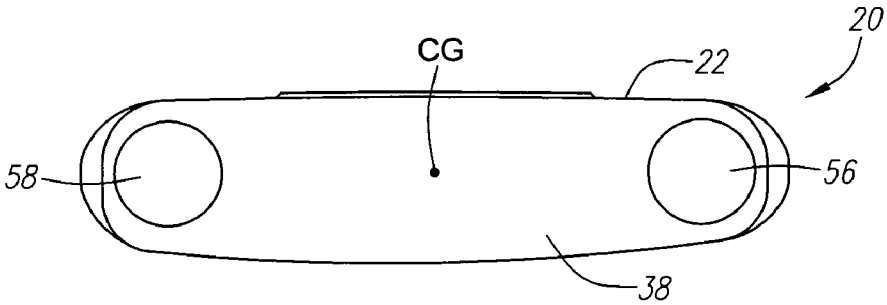
FIG. 4 is a front plan view of the putter-type club head of FIG. 2.

As shown in FIG. 3, each of the heel aperture 34 and the toe aperture 36 preferably has a length, Ls, of approximately 6 cm and a width, Ws, of approximately 2 cm. The heel section interior wall 28*a*, the toe section interior wall, not shown, and the central section interior wall 32*b* define the depth of each of the heel aperture 34 and toe aperture 36, both of which extend through the body 22.

The heel aperture 34, the toe aperture 36, the central slot 62, the auxiliary mass port 74, and the auxiliary slot 76 remove mass from the interior of the body 22 thereby increasing the moments of inertia of the putter-type club head 20. The moments of inertia of the putter-type club head 20 are further increased by the placement of the first mass member 56, the second mass member 58 and the third mass member 60 toward the perimeter of the body 22. In a preferred embodiment, the Iyy inertial value through the center of gravity, CG, is at least 500 g-cm$^2$ and more preferably approximately 800 g-cm$^2$.

Figure 8:
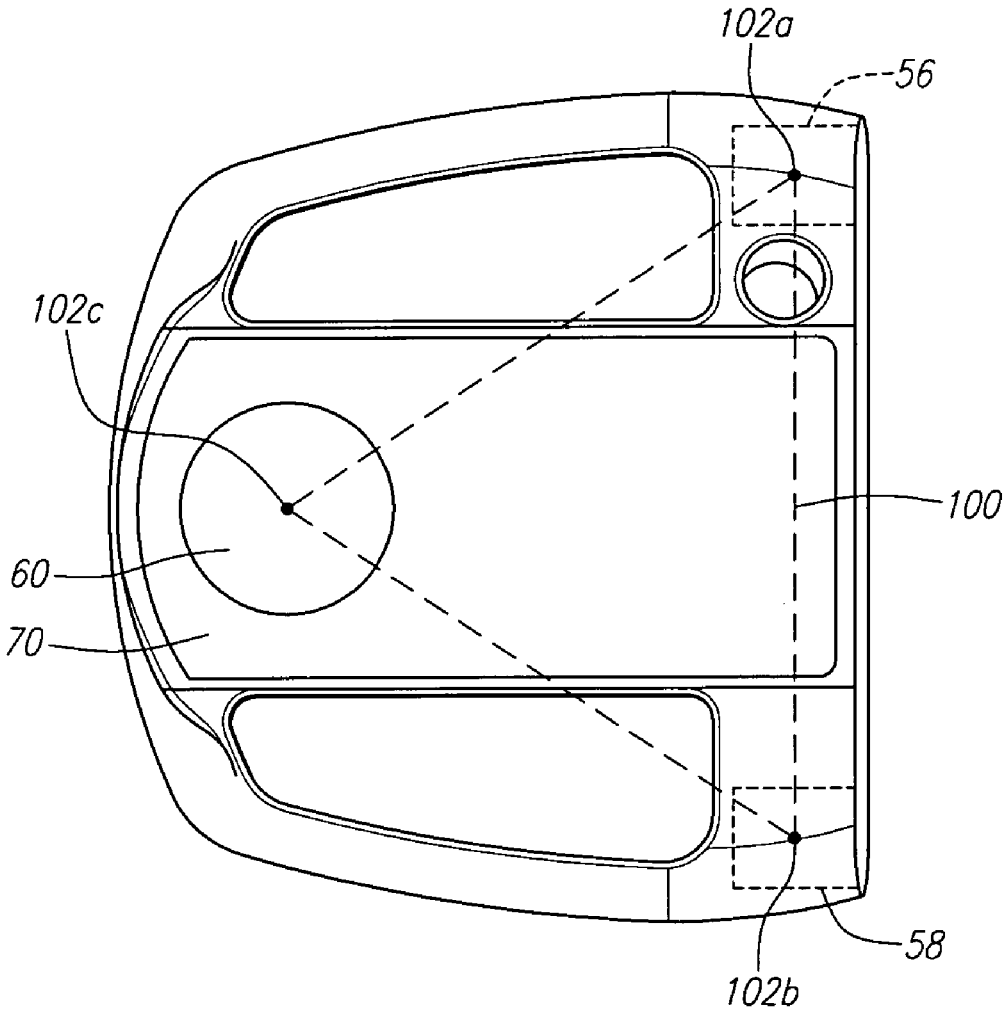
FIG. 8 is a top plan of a putter-type club head illustrating the triangular weighting of the putter-type club head.

As shown in FIG. 8, the triangular weighting of the putter-type club head 20 preferably positions the first mass member 56, the second mass member 58 and the third mass member 60 within a triangle 100 defined by the centers, 102*a*, 102*b*, and 102*c* of the first mass member 56, the second mass member 58 and the third mass member 60, respectively. In a preferred embodiment, the triangle 100 is equilateral with each side approximately 7.5 cm in length.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A putter-type club head comprising:

a body comprising a front section, an aft section, a heel section, a toe section and a central section, the body having a heel aperture defined by the heel section, central section, front section and aft section, the body having a toe aperture defined by the toe section, central section, front section and aft section, a face wall of the front section having a first mass port and a second mass port, a sole wall of the central section having a third mass port;

a first mass member disposed in the first mass port;

a second mass member disposed in the second mass port;

a third mass member disposed in the third mass port; and a crown plate placed within a recess within the central section of the body;

wherein the putter-type club head has a moment of inertia about the Iyy axis through the center of gravity of the club head of at least 500 g-cm$^2$.

2. The putter-type club head according to claim 1 wherein the crown plate comprises an alignment indicia.

3. The putter-type club head according to claim 1 wherein each of the first mass member, the second mass member and the third mass member is composed of a material with a density greater than the density of the material of the body.

4. The putter-type club head according to claim 1 wherein each of the first mass member, the second mass member and the third mass member is composed of a material having a density ranging from 6.0 g/cm$^3$ to 20.0 g/cm$^3$.

5. The putter-type club head according to claim 4 wherein each of the first mass member, the second mass member and the third mass member is composed of a material selected from the group consisting of brass, stainless steel, tungsten, silver, gold, nickel, nickel based alloys, iron based alloys, tin, copper and platinum.

6. The putter-type club head according to claim 1 wherein the body is composed of a material having a density ranging from 0.90 g/cm$^3$ to 6.0 g/cm$^3$.

7. The putter-type club head according to claim 1 wherein the body is composed of a material selected from the group consisting of aluminum, aluminum alloy, magnesium, magnesium alloy, titanium and titanium alloy.

8. A putter-type club head comprising;

a body comprising a front section, an aft section, a heel section, a toe section and a central section, the body having a heel aperture defined by the heel section, central section, front section and aft section, the body having a toe aperture defined by the toe section, central section, front section and aft section, a face wall of the front section having a first mass port and a second mass port, a sole wall of the central section having a third mass port;

a first mass member disposed in the first mass port;

a second mass member disposed in the second mass port;

a third mass member disposed in the third mass port;

wherein the putter-type club head has a moment of inertia about the Iyy axis through the center of gravity of the club head of at least 500 g-cm$^2$;

wherein the sole wall of the central section has a slot proximate to the front section.

9. A putter-type club head comprising:

a body comprising a front section, an aft section, a heel section, a toe section and a central section, the body having a heel aperture defined by the heel section, central section, front section and aft section, the body having a toe aperture defined by the toe section, central section, front section and aft section, a face wall of the front section having a first mass port and a second mass port, the central section having a third mass port and a fourth mass port, the body has a mass ranging from 200 grams to 1000 grams;

a first mass member threadingly engaged in the first mass port;

a second mass member threadingly engaged in the second mass port;

a third mass member threadingly engaged in the third mass port;

a fourth mass member threadingly engage in the fourth mass port; and a crown plate disposed on the central section, the crown plate composed of a non-metallic material.

* * * * *